United States Patent [19]

Burgess

[11] 4,317,334

[45] Mar. 2, 1982

[54] REMOTE REFRIGERATION SYSTEM WITH CONTROLLED AIR FLOW

[75] Inventor: Emerson F. Burgess, Villa Park, Calif.

[73] Assignee: Silva Restaurant Equipment Co., Inc., Cerritos, Calif.

[21] Appl. No.: 159,995

[22] Filed: Jun. 16, 1980

[51] Int. Cl.[3] ..... F25B 39/04

[52] U.S. Cl. ..... 62/183; 62/508; 62/509

[58] Field of Search ..... 62/183, 181, 508, 428, 62/507, 509, DIG. 17, 186, 429

[56] References Cited

U.S. PATENT DOCUMENTS

| | | | |
|---|---|---|---|
| 2,655,795 | 10/1953 | Dyer | 62/183 X |
| 3,064,445 | 11/1962 | Gerteis | 62/509 X |
| 3,093,976 | 6/1963 | Walcutt | 62/DIG. 17 |
| 3,112,620 | 12/1963 | Stewart | 62/DIG. 17 |
| 3,263,342 | 8/1966 | Giuffre | 62/428 X |
| 3,449,922 | 6/1969 | Ruff et al. | 62/183 |
| 3,460,354 | 8/1969 | Peterson | 62/507 |
| 3,478,533 | 11/1969 | Kocher et al. | 62/DIG. 17 |

*Primary Examiner*—William E. Wayner
*Assistant Examiner*—Harry Tanner
*Attorney, Agent, or Firm*—Warren T. Jessup

[57] ABSTRACT

A refrigeration system in which compressors are mounted in one compartment of the housing and condensers and receivers are mounted in an adjacent compartment. Ambient cooling air flows first into the compressor compartment, then into the condenser compartment, and then to the atmosphere. Parallel flow paths from the compressor compartment to the condenser compartment are provided—one flowing the air over the condensers, the other bypassing the condensers, before being expelled. The bypass has a movable flapper valve controlled by the ambient air temperature which causes the ambient air to bypass when its temperature drops below a given point. A shroud encloses the receivers and has a fan-driven heater controlled by the same thermal sensor that controls the flapper valve.

3 Claims, 1 Drawing Figure

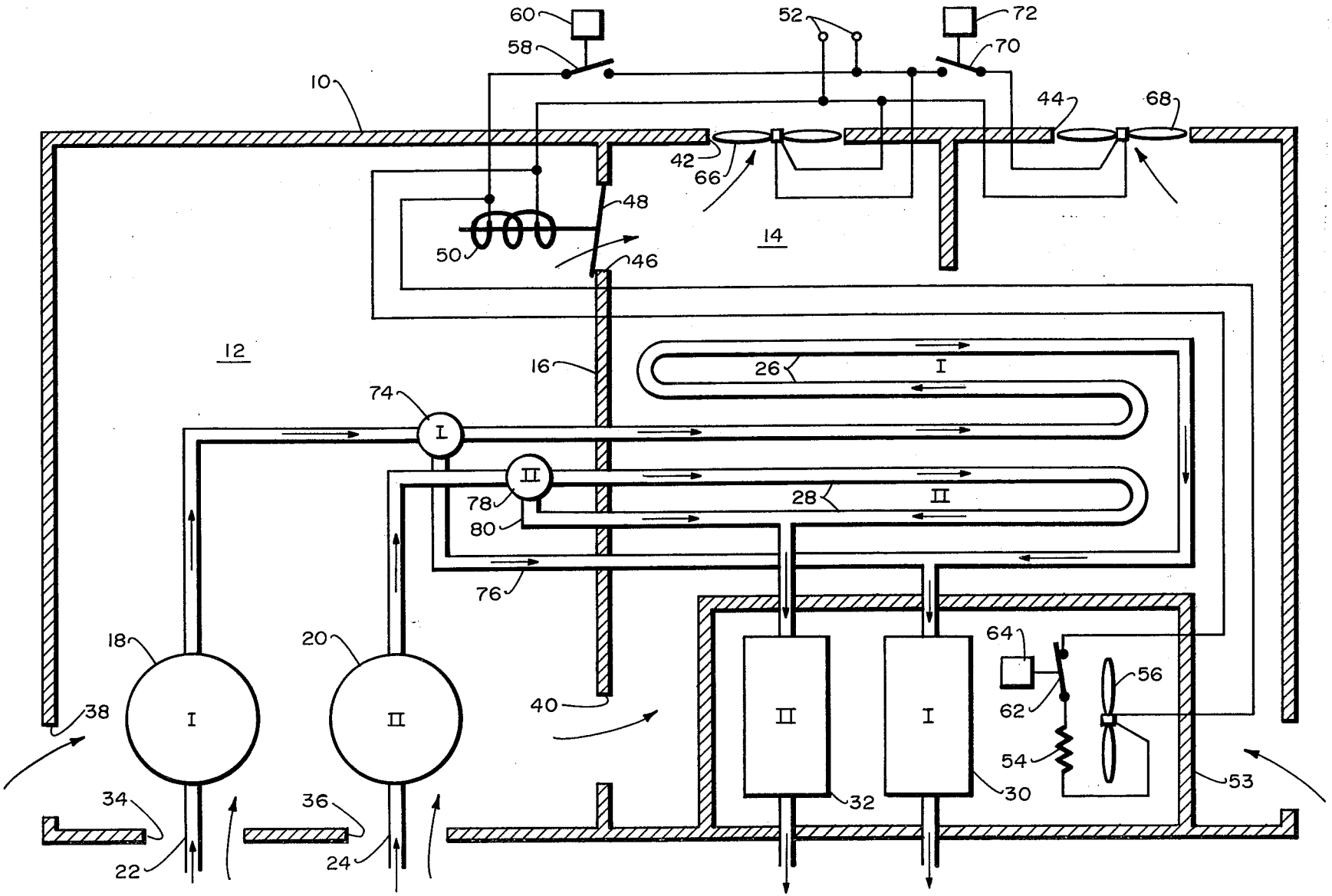
10
12
14
16
18
20
22
24
26
28
30
32
34
36
38
40
42
44
46
48
50
52
53
54
56
58
60
62
64
66
68
70
72
74
76
78
80
I
II

REMOTE REFRIGERATION SYSTEM WITH CONTROLLED AIR FLOW

BACKGROUND OF THE INVENTION

With relatively abundant and inexpensive energy, refrigeration systems, such as those designed to refrigerate large walk-in refrigerators in restaurants, have been designed primarily with an eye on convenience of use, compactness of structure and minimization of initial cost. With burgeoning energy and fuel costs, efficient operation calls for a reshaping of design criteria and such is the aim of the present invention.

SUMMARY OF THE INVENTION

The present invention involves a number of concepts which individually and collectively lead to a significant increase in efficiency in terms of energy used per quantum of refrigeration. One of the techniques of the present invention involves passing the ambient cooling air first over the compressors and then over the condensers, in contra distinction to the conventional practice. The present invention also involves a selective bypassing of such air around the condensers, depending on ambient temperature conditions. The system of the present invention operates over a wide range of ambient temperature, ranging from extreme cold to extreme heat.

BRIEF DESCRIPTION OF THE DRAWING

The single FIGURE illustrates, in largely schematic form, the concepts of the present invention from which the features to be described hereinafter can be discerned.

DETAILED DESCRIPTION OF THE PREFERRED EMBODIMENT

In the FIGURE, 10 represents a housing designed to be mounted on the roof of a commercial establishment, such as a restaurant. The housing 10 is divided, by a partition 16, into a pair of sub-housings or compartments 12 and 14. In the compartment 12 are mounted compressors 18 and 20 representing respectively the compression elements of two refrigeration circuits. Into the compressor 18 is fed, at 22, refrigerant from the evaporator of the first circuit, which may be loaded, for example, in a walk-in refrigerator. Into the second compressor 20 is fed, by conduit 24, refrigerant from a second evaporator, which may be located also in the refrigerator or elsewhere in the building to be cooled.

In the condenser compartment 14, are mounted a pair of condensers 26 and 28, corresponding respectively to the compressors 18 and 20. Condensed refrigerant from 26 flows into a receiver 30, and from condenser 28 into a receiver 32. Refrigerant from receiver 30 is then fed to the evaporator in the first system, and from receiver 32 to the evaporator in the second system or circuit. The refrigerant cycle is thus: from the compressor 18, to the condenser 26, receiver 30, evaporator (not shown) and thence back to the compressor 18. A similar cycle is established for the second system through the elements 20, 28, 32, evaporator, and back.

In accordance with the present invention, inlet openings are provided in the housing compartment 12 as shown at 34 and 36, directly beneath the respective compressors 18 and 20. Air is also admitted through a side opening 38. This ambient cooling air flows past the compressors 18 and 20 and thence from the compartment 12 to the compartment 14 by two parallel openings in the partition 16. The lower opening 40 flows air from compartment 12 into compartment 14, thence upwardly past the condensers 28 and 26, and out openings 42 and 44 in the roof of the housing compartment 14. Air may also pass from compartment 12 to compartment 14 via an upper opening 46, directly to the outlets 42 and 44, bypassing the condensers 26 and 28. This opening 46 is controlled by a valve means in the form of a flapper valve or butterfly 48, the position of which is controlled by a solenoid 50, energized from a source of electric power 52 through control switches to be described later.

The receivers 30 and 32 are isolated from the remainder of compartment 14 by a shroud or casing 53, the interior of which is selectively heated by a heating element 54 and a blower fan 56. Heater 54 and fan 56 are connected electrically in series and receive their power from the source 52 by being connected in parallel with the solenoid coil 50.

The solenoid 50 and heater/fan 54/56 are energized or enabled by an ambient temperature response switch 58, controlled by a temperature-responsive sensor 60. When the ambient temperature drops below a given point, e.g. 30° F., the sensor 60 closes the switch 58, energizing the solenoid 50 and the heater 54. This causes the flapper 48 to open the passage 46, resulting in bypassing a significant portion of the cooling air from the compartment 12, into the compartment 14, and directly out the outlets 42 and 44, while bypassing the condensers 26 and 28. Energizing of the heater 54 also applies heat to the receivers 30 and 32, thereby maintaining pressure therein, which is needed for proper operation of the refrigeration circuits. A switch 62 operated by a temperature sensor 64 is in series with the heater 54 and de-energizes or disables the heater when the temperature within the receiver shroud 53 rises above a predetermined point, e.g. 100° F.

In each of the air outlets or discharge openings 42 and 44, is a power-driven fan 66 and 68, respectively, to circulate air through the housing 10 and back into the atmosphere. As shown, the fan 66 is permanently connected to the power source 52 and operates continuously when the system is in operation. The fan 68 is energized through a switch 70 controlled by temperature sensor 72. The fan 68 is inoperative below a given ambient temperature. For example, the switch 70 closes (with resultant energization of fan 68) when the ambient temperature exceeds 85° F. and the switch 70 opens when the ambient temperature drops below 80° F.

In flowing from compressor 18 to condenser 26, the refrigerant passes through a T-valve 74. In order to maintain pressure in the receiver 30, should the input pressure to the valve 74 drop below a given value, e.g. 130 psi, the valve 74 diverts flow from the condenser 26 directly to the receiver 30 by way of the bypass conduit 76. Similarly the T-valve 78, under such conditions, bypasses refrigerant around the condenser 28 and directly to the receiver 32, via the conduit 80.

OPERATION

In what might be called a normal temperature range, e.g. 32° to 85° F., the following prevails: The switch 58 is open; the flapper valve 48 is closed; the heater and fan 54/56 are not operating; the fan 66 is blowing continuously; the fan 68 is deenergized by virtue of the open switch at 70. Under these conditions, air is impelled by the fan 66 through the openings 34, 36 and 38, around the compressors 18 and 20, through the opening 40, past the condensers 28 and 26 and out the opening 42. If the temperature drops below a given point, e.g. 30° F., switch 58 closes, applying power from terminal 52 to the solenoid 50, which opens the flapper 48 and bypasses a significant portion of the air around the condensers 28 and 26. Closing of switch 58 also energizes the heater and fan 54/56 through the closed switch 62, applying heat to the interior of the shroud 53, and maintaining the receivers 30 and 32 at sufficiently high operating pressure. When the ambient temperature rises to a given point, e.g. 35° F., the switch 58 opens and normal operation resumes.

Should the temperature rise above a given point, e.g. 85° F., the sensor 72 closes the switch 70, energizing the fan 68 and causing air to also be evacuated through the opening 44 as well as the opening 42. This added air flow through the system continues until the ambient temperature drops to a given point, e.g. 80° F., whereupon the switch 70 opens, de-energizing the fan 68, and normal operation resumes.

The present design minimizes the number of motor-driven fans required for a given system, with resulting substantial saving in energy. The design also effects full and precise control of all phases and modes of operation of the system with a minimum number of discrete controlling elements, with consequent simplification and economy in maintenance and enhanced operational dependability.

What is claimed is:

1. In a refrigeration system comprising a compressor, a condenser, and a receiver, and conduit means for flowing refrigerant from the compressor through the condenser and thence to the receiver, the combination comprising:

a shroud substantially enclosing said receiver;

heating means within said shroud for imparting heat to the interior thereof; ambient responsive control means for enabling said heating means to impart heat to the interior of said shroud, said ambient control means being responsive to the temperature in the ambient atmosphere in which the refrigeration system is mounted.

2. System in accordance with claim 1 including:

shroud responsive control means for disabling said heating means when the temperature within said shroud reaches a predetermined value.

3. Refrigeration system comprising a housing divided into a compressor compartment and a condenser compartment:

compressor means in said compressor compartment, condenser and receiver means in said condenser compartment, conduit means for flowing refrigerant from said compressor means through said condenser means to said receiver means;

air inlet means for admitting ambient air into said compressor compartment;

air outlet means for evacuating air from said condenser compartment;

first passage means for flowing air from said compressor compartment into said condenser compartment past said condenser, and thence through said outlet means;

second passage means for flowing air from said compressor compartment to said outlet means, bypassing said condenser, said second passage means including valve means for blocking or inhibiting air flow therethrough;

heating means for heating said receiver means;

ambient temperature sensor means for sensing ambient temperature;

temperature-responsive control means for controlling said valve means and said heating means in accordance with ambient air temperature as sensed by said ambient temperature sensor means.

* * * * *